United States Patent [19]

Jennings

[11] 4,035,793

[45] July 12, 1977

[54] SIGNALING INTERVAL TIMER

[76] Inventor: Vincent M. Jennings, 25 Fairmount Ave., Hackensack, N.J. 07601

[21] Appl. No.: 695,256

[22] Filed: June 11, 1976

[51] Int. Cl.[2] ..... G04F 1/08; H01H 47/18

[52] U.S. Cl. ..... 340/309.1; 58/39.5; 58/21.13; 340/309.4

[58] Field of Search ..... 340/309.1, 309.4; 58/144, 39.5, 21.13

[56] References Cited

U.S. PATENT DOCUMENTS 3,492,811 2/1970 Shore ..... 58/144

*Primary Examiner*—Harold I. Pitts

*Attorney, Agent, or Firm*—Joel Halpern

[57] ABSTRACT

A signaling interval timer includes a hollow unitary housing having a peripheral slot therein. A sealed flexible hollow elongated bag filled with a viscous liquid is affixed within the housing adjacent to the slot. A spiral coil spring is mounted within the housing and is provided at its outer end with an arm adapted to move along a predetermined path across a surface of the elongated bag. Pressure regulating means are provided for varying the pressure which the arm exerts upon the elongated bag. Signal means are provided for generating an audible signal when the arm moves to a predetermined position along the path.

7 Claims, 7 Drawing Figures

TIME EXPIRED
TIME EXPIRED

SIGNALING INTERVAL TIMER

BACKGROUND OF THE INVENTION

1. Field of the Invention

The present invention relates to timing devices, and more particularly, to a signaling interval timer.

2. Description of the Prior Art

The prior art includes several complex signaling interval timers which employ a series of cooperating gears and pivotal elements that are urged by a coil spring or the like. These devices are complex in design, expensive, and afford a degree of accuracy unwarranted for many applications such as timing a parking meter or a wash load at a laundromat.

U.S. Pat. No. 3,000,172 to R. Beauman issued Sept. 19, 1961 discloses a time meter alarm device which employs a spring powered clockwork type movement disposed between two pillar plates and a driving member which cooperates with the clockwork type movement and activates an alarm device.

U.S. Pat. No. 3,323,303 to R.P. Jaccard issued June 6, 1967 teaches an interval timer which employs a clockwork mechanism having a timer wheel and a time wheel, the timer wheel being pivotally affixed to a movable pivot and the time wheel being pivotally affixed to a stationary pivot. When the time wheel is engaged by the timer wheel a specific time may be set.

The present invention provides a compact, pocketable, inexpensive timer which is durable, simple in design, and employs few moving parts.

SUMMARY OF THE INVENTION

Therefore, it is a primary object of the present invention to provide a simply constructed signaling interval timer which employs few movable parts.

Another object is to provide a signaling interval timer which may be set for various time intervals and multiples thereof.

These objects, as well as further objects and advantages, of the present invention will become readily apparent after reading the description of a non-limiting illustrative embodiment and the accompanying drawing.

According to the present invention there is provided a signaling interval timer comprising; a hollow unitary housing having an elongated slot in a peripheral edge thereof, a sealed flexible hollow elongated bag fixedly secured within the housing adjacent the elongated slot, the elongated bag being filled with a viscous liquid, a spiral coil spring mounted within the housing having the outer free end thereof extending generally radially outwardly to thereby form an arm adapted to slide within the slot arm section adapted to slidably cooperate with and frictionally move across a surface of the elongated bag and exert a predetermined pressure thereon, pressure regulating means for varying the pressure the arm exerts against the elongated bag, and signal means for providing an audible signal when the arm moves to a predetermined position along the path.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figures 1, 2, 3, 4, 5, 6, 7:
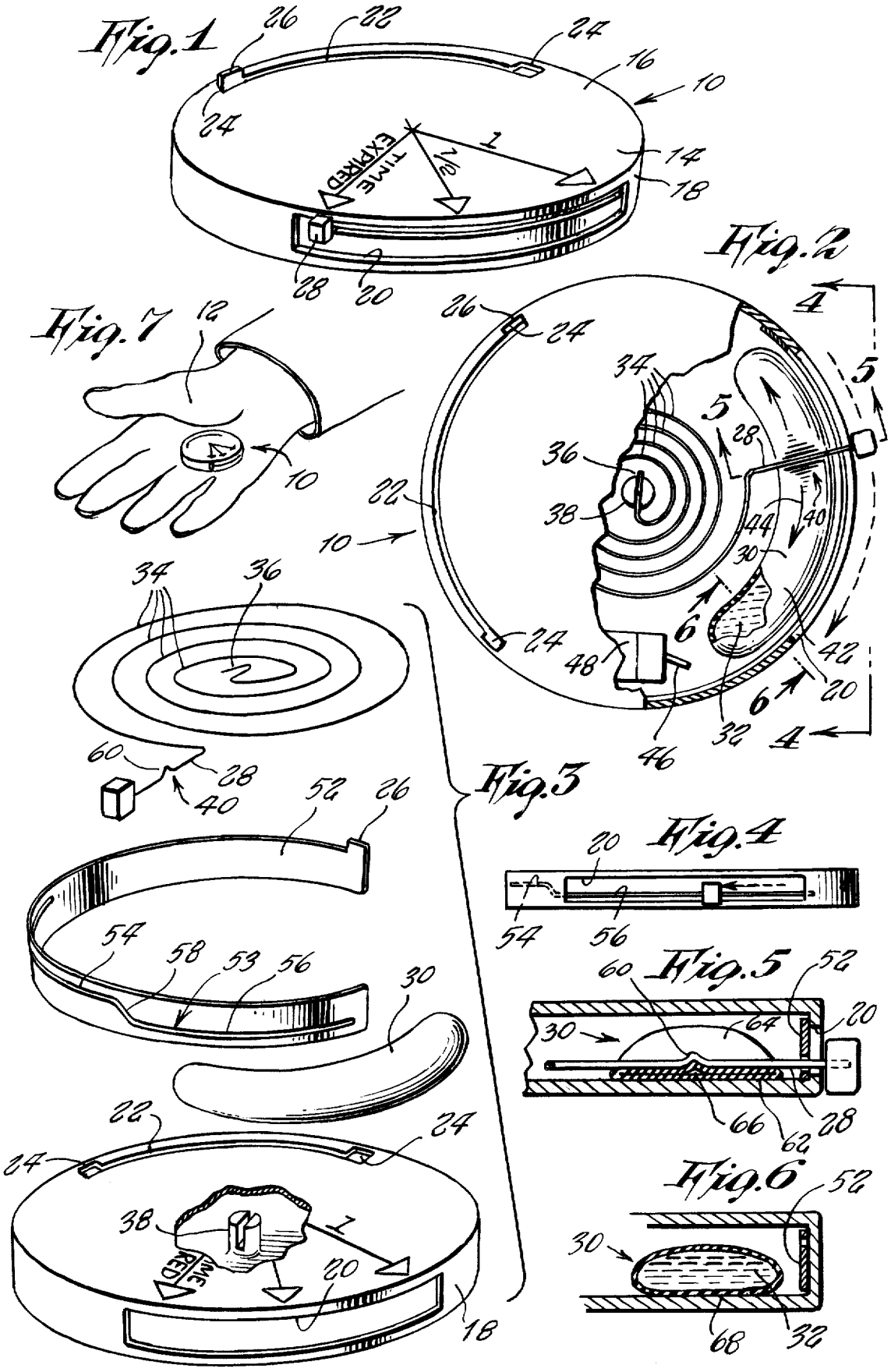
FIG. 1 is a perspective view of a signaling interval timer embodying the features of the present invention.
FIG. 2 is a top plan view, partially broken away, of the timer shown in FIG. 1.
FIG. 3 is an exploded view, partially broken away, of the timer shown in FIG. 1.
FIG. 4 is a side view of the signaling interval timer of FIG. 2 viewed in the direction of arrows 4—4 thereof.
FIG. 5 is a cross-sectional view of the timer shown in FIG. 2 taken along line 5—5 thereof.
FIG. 6 is a cross-sectional view of the timer shown in FIG. 2 taken along line 6—6 thereof.

Referring now to the drawings, and more particularly to FIG. 1, there is illustrated generally the presently preferred embodiment of the invention, a signaling interval timer 10. The timer is also depicted in FIG. 7 positioned in a user's hand 12. The timer 10 includes a generally disc-shaped housing 14 having an upper surface 16 and a peripheral edge 18. A slot 20 is formed in the peripheral edge and extends throughout a predetermined arcuate distance. An arcuate locking slot 22 is formed in the upper surface 16 preferably adjacent the edge 18 and is provided at the opposed ends thereof wth retaining notches 24. Notches 24 are adapted to removably frictionally secure therein an extension tab 26 hereinafter described. The notches 24 may be labeled "full time" and "half time" for a purpose which wil hereinafter become clear. The slot 20 is of sufficient dimension to permit the traverse therewithin of an arm section 28 as will be further described. The slot 20 may be labeled "1 hour" at one end thereof and "time elapsed" at the other end thereof. The designation "one half hour" may be provided at the mid-point of the slot.

As can be seen most clearly in FIG. 2, a sealed flexible hollow elongated bag 30 is fixedly secured within the housing 14 adjacent to the slot 20 and is filled with a viscous liquid 32 such as oil or the like. The bag 30 may be constructed of a synthetic plastics material or another suitable material of the desired flexibility. A spiral coil spring 34 is mounted within the housing 14, preferably concentrically therewithin such that its coils lie in a common plane. The inner end portion 36 of the coil spring is fixedly secured to a notched post 38 carried within the housing 14. The outer end portion 40 of the coil spring is angularly displaced from the coils thereof and provides a generally radially extending arm section 28. The arm section 28 is adapted to slidably cooperate with and frictionally traverse the underlying surface 42 of the bag 30 at a predetermined pressure throughout a predetermined path 44 of travel. When the arm section 28 moves to an extremity of its travel path it is adapted to engage pushbutton switch 46. The switch 46 is wired in a circuit with a buzzer 48 and a battery (not shown) to provide an audible signal upon its actuation by arm 28.

The pressure which the arm 28 exerts upon the surface 42 of bag 30 is regulated by means of an elongated arcuate plate 52 as shown in FIG. 3. The plate 52 is formed with a peripherally extending slot 53 which is dimensioned to slidably receive the arm 28 for movement therealong. The slot includes a first and second parallel spaced segments 54, 56 connected by an offset section 58. The plate 52 may be positioned within the housing such that arm 28 rides within segment 54 or 56. The plate 52 is provided at an end remote from slot 53 with extension tab 26 which serves to lock the plate in position by the securing of the extension tab 26 in one of the retaining notches 24 as described above.

As can be seen from FIG. 4, the arm 28 travels along path 44 within segement 56 of the plate 52.

FIG. 5 illustrates the arm 28 traveling along path 44 over the surface 42 of the bag 30. A triangular bend 60 is provided in the arm 28. As the coil spring 34 urges the arm 28 across surface 42 along path 44 the viscous liquid 32 within bag 30 is forced from a section 62 of the bag in front of the arm 28 to a section 64 of the bag behind the arm 28 through a portion 66 of the bag adjacent to the bend 60. Depending upon the pressure exerted by the arm 28 upon surface 42 the bend 60 may not be required for proper movement of the arm 28.

The bag 30 may be fixedly secured to the housing 14 by adhesive 68 or the like as shown in FIG. 6.

In use, the user moves the arm 28 adjacent to the indicia "one hour" or "one half hour" as desired. The extension tab 26 is positioned in the notch labeled "full time." When the arm 28 is released it will slowly travel across the bag 30 under the influence of spring 34 until it reaches the pushbutton switch 46 which thereupon generates an audible signal designating the end of the selected time interval. If a shorter time interval is desired the extension tab 26 is placed in the notch 24 which is labeled "half time" and the time intervals set with the arm 28 will be regulated accordingly.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A signaling interval timer comprising:

a hollow unitary housing having an elongated slot in a peripheral edge thereof;

a sealed flexible hollow elongated bag fixedly secured within said housing adjacent said elongated slot, said elongated bay being filled with a viscous liquid;

a spiral coil spring mounted within said housing having the outer free end thereof extending generally radially outwardly to thereby form an arm adapted to slide within said slot arm section adapted to slidably cooperate with and frictionally move across a surface of said elongated bag and exert a predetermined pressure thereon;

pressure regulating means for varying the pressure said arm exerts against said elongated bag;

and signal means for providing an audible signal when said arm moves to a predetermined position along said path.

2. A signaling interval timer according to claim 1, wherein the inner end portion of said pin coil spring is fixedly secured to an inner surface of said housing.

3. A signaling interval timer according to claim 1, wherein said pressure regulating means comprises an elongated arcuate plate movably mounted within said housing and having a peripherally extending pressure varying slot therein, said arm being adapted to slide within the portion of said elongated pressure varying slot adjacent thereto to thereby position said arm at selected distances relative to said elongated bag and thereby vary the pressure thereagainst.

4. A signaling interval timer according to claim 3, wherein said elongated pressure varying slot is provided with first and second parallel spaced segments connected by an offset section.

5. A signaling interval timer according to claim 4, wherein said plate includes locking means for positively positioning said first and second segments adjacent said arm.

6. A signaling interval timer according to claim 5, wherein an extension tab is formed at one end of said plate, said locking means comprising an elongated locking slot located in said housing, said locking slot having a retaining notch at each end thereof, said retaining notches being adapted to releasably frictionally secure therein said extension tab, and said tab being adapted to slidably cooperate with said locking slot when moved therein from one of said retaining notches to the other of said retaining notches.

7. A signaling interval timer according to claim 1, wherein said signaling means comprises an electrical buzzer, a battery for powering said buzzer, and a pushbutton switch adapted to be urged by said arm for activating said electrical buzzer.

* * * * *